United States Patent [19]

Dingler

[11] Patent Number: 4,881,716

[45] Date of Patent: Nov. 21, 1989

[54] ASSEMBLY FOR PREFABRICATED FORMWORK

[76] Inventor: Gerhard Dingler, Schillerstrasse 49, 7274 Haiterbach, Fed. Rep. of Germany

[21] Appl. No.: 255,387

[22] Filed: Oct. 11, 1988

[51] Int. Cl.[4] ..... E04G 17/04

[52] U.S. Cl. ..... 249/192; 249/47; 249/219.1; 254/104; 269/234

[58] Field of Search ..... 249/33, 44, 47, 189, 249/191, 192, 194, 219.1; 269/234; 254/104

[56] References Cited

U.S. PATENT DOCUMENTS

| | | | |
|---|---|---|---|
| 1,593,610 | 7/1926 | White | 249/219.1 |
| 2,882,583 | 4/1959 | Arrighini et al. | 249/192 |
| 3,761,049 | 9/1973 | Theeke | 249/192 |
| 4,188,017 | 2/1980 | Dingler | 249/219.1 |
| 4,529,163 | 7/1985 | Dingler | 249/219.1 |

FOREIGN PATENT DOCUMENTS

| | | | |
|---|---|---|---|
| 0201887 | 11/1986 | European Pat. Off. | 249/219.1 |
| 2716864 | 10/1978 | Fed. Rep. of Germany | 249/219.1 |
| 2759966 | 4/1986 | Fed. Rep. of Germany | . |
| 3545273 | 6/1987 | Fed. Rep. of Germany | 249/219.1 |

*Primary Examiner*—James C. Housel

[57] ABSTRACT

Projections are provided on the clamp portion of a formwork lock. The projections are spaced from inwardly extending inclined surfaces of the claws of the clamp. The projections engage the outer sides of the corners of the flange of a formwork panel frame, while the inwardly extending surfaces on the claws engage complementary surfaces of the framework panel frame.

22 Claims, 3 Drawing Sheets

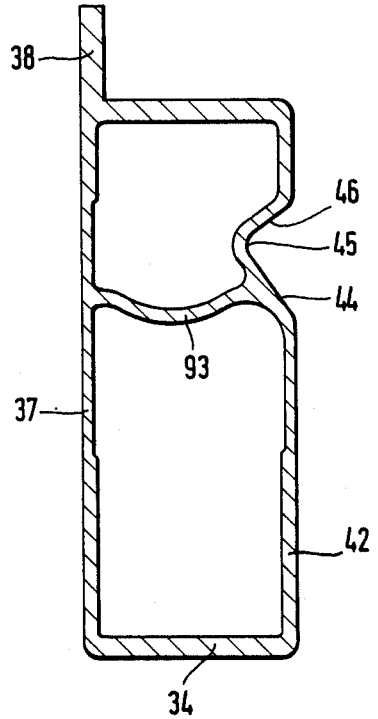
FIG. 4
FIG. 5
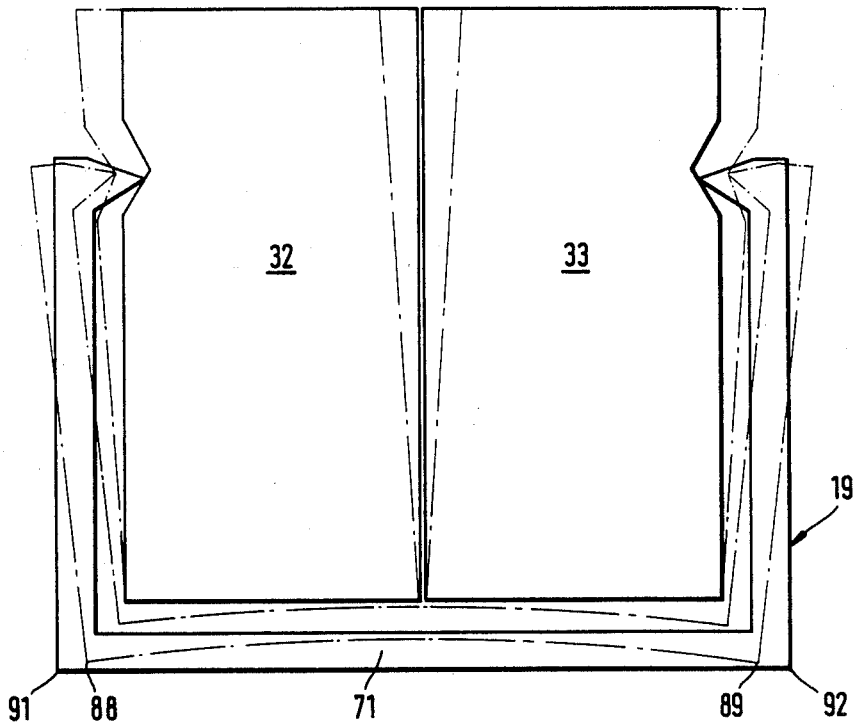

ASSEMBLY FOR PREFABRICATED FORMWORK

This invention relates to a composite assembly of two formwork panels and formwork locks for element forms, with at least two clamping positions. Each of the formwork panels has a formwork panel profile frame.

BACKGROUND OF THE INVENTION AND RELEVANT PRIOR ART

Such apparatus is known, for example, for German Patent Specification No. 27 59 966.

Such prefabricated forms have since become differentiated into lighter formwork and heavier formwork. The lighter formwork is frequently termed "housebuilders' formwork", by which concreting can be carried out to heights of up to 300 cm. Residential rooms also have heights of about 200 cm, so that a 300 cm formwork height is rather exceptional. There is also industrial and civil engineering formwork, with which, of course, lower heights can also be formed, but with which heights of up to 10 meters can be achieved, corresponding to the higher structures in industry and civil engineering.

Housebuilders' formwork is usually lighter than industrial and civil engineering formwork. The former weighs approximately up to 40 kg/m$^2$ and the latter on average is above this fixture. The differences in weight arise from the fact that, in the one case, the profile frame and transverse members are less stiff and the formwork panel is somewhat thinner than in the other type. The differences can also be recognized in the size and weight of the formwork locks. A formwork lock for housebuilders' forms has a weight of the order of 1 kg, whereas a formwork lock for industrial and civil engineering formwork is of the order of 3 kg in weight.

The formwork locks are castings or they may be welded from steel plate. The profile frames are closed hollow profiles, which are extruded from aluminum or, much more frequently, are cold-rolled steel profiles.

For such forms, a quality criterion is what formwork pressure they can withstand. Concrete is almost exclusively the material formed, and the wet concrete produces the formwork pressure. West German Standard DIN 18 216 provides information about how the formwork pressure increases as a function of concrete consistency and rate of concreting.

West German Standard DIN 18 202 gives planarity tolerances for surfaces of walls. They are listed under item 2. Of course, no form can give an absolutely flat wall. The form will, of course, tend to bulge rather more at the bottom due to the pressure increase with height. Formwork manufacturers aim to supply forms that as far as possible come within the highest accuracy class, without sacrificing essential requirements, such as flexibility, weight, simple construction, etc.

The bending deflections are related to the intervals between measuring points. If the measuring points are 1 meter apart, then the unevenness may only be 3 mm to meet the most exacting requirements.

Hitherto, the highest loadings of industrial and civil engineering formwork were from 40 to 80 kN/m2. It was thought that the number of anchor points and the diameter of the anchor bar and quality of material from which it was made should determine the maximum possible loading. It was through that if, for example, the Dywidag bar of material quality St 90/110 and 15 mm diameter, can accept a load of 01 kN with a safety factor of 1.75, then taking into account the concreted area of 1.52 m, a formwork press of 60 kN/m can be accepted. For a concreted area of 2.27 m, the figure was 40 kN/m.

It was also believed that the rate of concreting must depend upon such parameters. Discussions on this subject will be found, for example, in the "Algemeine Bauzeitung" ("General Civil Engineering News"), of Sept. 20, 1985.

Such prefabricated formwork, also know as element formwork, consists of formwork panels, which fit a grid having a length and width varying according to the manufacturer. There are very wide and very narrow elements. There are high elements and also shallow elements. For very many different reasons, in all these formwork panels the profile frames must be made from the same profile, regardless of whether the element is of the smallest or the largest type. The transverse members also must be made from the same profile, independently of the size of the element. The transverse members must also be provided in the same grid, that is to say, it is not possible, for example, to provide only every third transverse member for the smaller elements.

This means that the largest elements must comply with the tolerances.

In concreting, the pressure is exerted on the formwork panel from the front. Having regard to the anchor points present, this means that two adjacent frame members have a tendency to open between them a wedge-shaped gap towards the concrete, or even actually to open apart.

A quite different type of loading of such an assembly, which for example, may consist of ten formwork panels, exists at the instant at which the assembly is suspended from the rope of a crane. Due to wind, catching on an object or by oscillating forces, it may be that the panel is loaded from behind. Just the opposite tendency then occurs, namely the tendency for a wedge-shaped gap to form towards the outside or for this gap actually to open out. If this happens several times, it can occur that the formwork locks lose their grip and the assembly partly or entirely collapses. The consequences do not need to be explained further.

It is well known that other types of loading also occur, perhaps by the use of internal vibrators, the vibrating component of which is lowered into the concrete. Certainly, the vibrator should not come into contact with the formwork, but sometimes this cannot be prevented, for example, when the vibrator slips.

There are also the so-called external vibrators, which are fixed to the outside of the form and vibrate at high frequency. This type of loading is also objectionable.

The formwork panels should, of course, continue to remain in alignment, because if the tolerance is consumed by errors in alignment, then none remains for the errors caused by bending of the form.

The deflection of the formwork panel is, moreover, not determined by the panel being to a greater or lesser extent fitted at the edge into the profile frame, but instead the panel is supported on its rear face by the transverse members. When these members deflect then they exert a torque upon those arms of the frame to which they are firmly fixed (e.g. welded).

The embodiment described, has two mutually parallel frame arms, a plurality of stiff transverse members that are parallel to one another, are spaced approximately at equal intervals apart and have ends that are rigidly connected with the two mutually parallel frame arms. A formwork panel is situated against the front of the transverse members and supported by them.

The frame arms have an outer transverse surface, an internal periphery, a first slope extending along the internal periphery, which slope lies nearer to the formwork panel than to the outer transverse surface, ascends outwardly and is at a constant distance throughout from the outer transverse surface.

A first region of the frame arms possesses the outer transverse surface. A second region possesses an external bearing surface which is at least partly perpendicular to the formwork panel and adapted to bear against a bearing surface of an adjacent formwork panel. A third region extends behind the formwork panel, and a fourth region possesses the first slope and is spaced at a distance from the second region.

First regions on adjacent formwork panels are in alignment. The first and fourth regions each form a corner having an external corner surface on the fourth region, and the frame arms are elastically compressible perpendicularly to the fourth region in the region of the first slope.

Such apparatus further has formwork locks with two claws, a yoke with an inner surface, and a wedge drive for each formwork lock. The two claws have claw roots and mutually-facing regions with second slopes that cooperate with the first slopes and press adjacent frame arms towards each other and towards the yoke. A flat bearing surface is on the inner face of the yoke, against which the outer transverse surfaces of the frame arms bear in an aligning manner at least over partial zones. Projections are on the mutually-facing regions on the claw roots at the level of the corner surfaces. The projections are appreciably shorter than the length of the claws, a free space being present between the projections and the second slopes.

OBJECT AND STATEMENT OF THE INVENTION

The object of the present invention is to provide an assembly by which, with minimal changes, greatly increased concrete pressures can be achieved, so that forming can be carried out with substantially higher concreting rates than previously was possible. Retraining must not be required and it should not be necessary to considerably stiffen the formwork panels, tension anchors, formwork locks or the like. The solution must be capable of use both with steel forms and with aluminum forms. It must also be possible for all the existing auxiliary equipment to continue to be used. If desired, it should also be possible to not change anything at all at the formwork panels themselves.

It must also be possible to use a working cycle in which concreting is carried out at the end of a working day, so that the concrete setting times which restrict the progress of work occur during the rest period. Every work planner is aware that the working hours employed for placing concrete on average occur more in the morning than in the afternoon, when quitting time approaches. From these requirements it arises that the rate of concreting should be at least 3 m/hour. It should be possible to achieve concrete pressures between 50 and 95 kN/m, even when concreting must be carried out in such a way that, according to DIN 18 202, the maximum deflection must be only 3 mm with a spacing of the measuring points of 1 m.

According to the invention, these objects are achieved by the following features:

(a) The projections always bear against the corner surfaces on the fourth region with a force that is greater than the opening force on the profile frames that occur in operation, and (b) With the projections against the corner surfaces, the second slopes on the claws are still at a distance from a possible limiting position on the first slopes on the fourth regions even after forces have been applied onto the wedge drive by hammer blows from building hammers and before permanent deformation of the first and fourth regions.

In respect of constructional detail, this means that the projections, for example, in the so-called MAMMOTH formwork of the firm Meva, are made higher only by fractions of a millimeter to a few milimeters, and this dimension is also monitored as a tolerance dimension in the fabrication of the formwork locks. The projections hitherto had only guidance functions and served for reinforcing the claws in the region of the root.

It would therefore not be sufficient if the corner area were to be solely in bearing or in bearing with a too small force. Because of material properties and because of the lever ratios resulting from the relatively long transverse members, the planarity tolerance, for example, of 3 mm would then rapidly be exceeded.

The preferred embodiment discloses the following additional advantageous features:

The first regions are quasi-incompressible. The results is that these first regions do not deflect even if the wedge drive is tightened up too much, e.g. as a precaution or due to inattention. The term "quasi" is a term frequently used in mathematics and technology for characterization. See, for example, Meyer's Lexikon der Technik und der exakten Naturwissenschaften ("Dictionary of Technology and Exact Natural Sciences") vol. 3, pages 2088 and 2089.

The first regions have a first specific, clear dimension across the corner surfaces. The projections in their theoretical position have a second clear dimension between them, which is equal to the first clear dimensions. The second slopes, when the second clear dimension is present, have a third clear dimension between them. The second slopes then have their theoretical position on the first slopes. By this design, the assembly can be constructed and the components designed in the lightest possible manner.

The slopes are at a distance from the first regions equal to more than one-half of the width of the fourth regions. By this feature, an approach is made near to the third regions, which is favorable in respect of levers and forces, so that this region can reduce a considerable part of the force. Nevertheless, in contrast to the conditions in the first region, one is still in the elastic range.

The distance of the slopes is about $\frac{2}{3}$ to $\frac{3}{4}$ of the width. These dimensions prove very satisfactory in the dimensions and materials used in the technology, and quite independently of whether, for example, extra corrugations are provided for other purposes.

The arms are of cold-rolled steel and form a closed profile. Such frame arms are themselves known and can continue to be used without modification.

The first regions consist of two flanges butt-welded together. Accordingly, the result is that the welding equipment and the position of the weld seam do not need to be changed. the weld seam is also capable of accepting the suddenly increased compressive forces.

Large-area forms have a formwork panel dimension upwards from at least 250 cm height × at least 75 cm width, in which the force on the corner surfaces is between 15 and 50 kN with from two to three formwork locks disposed along the height. This design is sufficient for approximately doubling the formwork pressure which can be accepted by an industrial and civil engineering form, if the bending deflection is not to exceed 3 mm with a measuring point spacing of 1 m.

The force on the corner surfaces is 30 plus/minus 25% kN. This design is sufficient for the so-called MAMMOTH formwork of the firm Meva, of Haiterbach, West Germany, and for related formworks, such as the FRAMAX-FRAME formwork of the firm Doka, of Munich, West Germany, the MANTO-FORMWORK of the firm Hunnabeck, of Ratingen, West Germany, and the TOP formwork of the firm Noe, Sussen etc.

The force on the corner surfaces is 30 plus/minus 10% kN. By this feature a finer limitation of the required force is obtained.

Two to three clamping positions are provided through the height. The number of clamping points can be reduced to a minimum (two clamping points are sufficient) without, for example, the bending deflection increasing above 3 mm for a 1 meter spacing of measuring points. It is possible to manage with so low a number of formwork locks, particularly if the formwork locks are provided directly above or below the transverse members.

A housebuilders' formwork has a formwork panel dimension upwards from 250 cm. height × at least 75 cm width, in which the force on the corner surfaces is between 7 and 25 kN with two to three formwork locks disposed on 250 cm. By these features, values are obtained for housebuilders' formwork, with which forming is carried out indeed only to the height necessary for house building, but which is also lighter and the profile frames and transverse members of which are also considerably weaker.

The force on the corner surfaces is 15 plus/minus 25% kN. Or, the force is 15 plus/minus 10% kN. These features give a still better limitation of the force. Higher forces are, of course, harmless because as in the case of industrial and civil engineering formwork, the frame arms and formwork locks readily withstand higher forces.

Two to three clamping positions are provided. This teaches how few clamping points it is possible to manage with, and here again it is favorable to provide the formwork locks as closely adjacent as possible to the transverse members.

The framework arms are of aluminum and more than three formwork locks are provided. This gives the appropriate numbers for aluminum formwork, which is available on the market both as housebuilders' formwork and as industrial and civil engineering formwork. More formwork locks are necessary here because, for the same profile cross-section, the frame arms are more easily twisted and the transverse members, which of necessity are of the same material, more readily bent.

At least four formwork locks are provided. Thus, even high forming heights are possible.

The projections are provided partly to completely at the corner surfaces. The projections do not necessarily have to be provided exclusively at the root of the claws. If the projections were to be provided on the steel profile and a frame arm, this would involve at least one extra set of rolls. In the case of aluminum profiles, in contrast, the shaping is simpler to carry out because in the case of extrusion there is no difference whether one step more or less is present. If the projections are provided on the frame arms, then the objection is that this means the provision of a further corner, against which concrete can stick in spite of cleaning.

In the two formwork panels, the frame arms have the same cross-section and are of the same material. Production, storage, the use of auxiliary equipment, calculation, are simplified, and it makes no difference what formwork panel is used alongside what other formwork panel.

The same is true for the following features: In the two formwork panels, the transverse members have the same cross-section and are of the same material.

The frame arms are known in the prior art. The formwork panels hitherto used can still be employed and minimal changes are required only to the formwork locks.

The transverse members are known in the prior art. The same applies for this feature.

The transverse members are at least half as high at the fourth region. In the case of certain forms that do not need to comply with the most exacting requirements, material and weight can be saved and, nevertheless, a good transfer of the forces from the transverse members into the frame arms is obtained.

The transverse members are 90 to 100% of the height of the fourth region. An optimum transfer of the forces coming from the transverse members into the vertical frame arms is obtained.

The transverse members are welded at their ends to the fourth region. This results in an especially rigid and reliable transfer of the forces from the transverse members into the frame arms.

The clear dimension between the projections corresponds to the clear dimension of two adjacent first regions.

There are about as many formwork locks as the number of transverse members, which does not fall below the number of transverse members by more than 15%.

DESCRIPTION OF THE DRAWINGS

The invention will now be described by reference to a preferred embodiment thereof, in which

FIG. 4 is the cross-section through an aluminum frame arm;

FIG. 5 is a schematic cross-section similar to FIG. 2 for explaining the action of the invention in the opinion of the inventor.

DETAILED DESCRIPTION OF A PREFERRED EMBODIMENT

Figure 1:
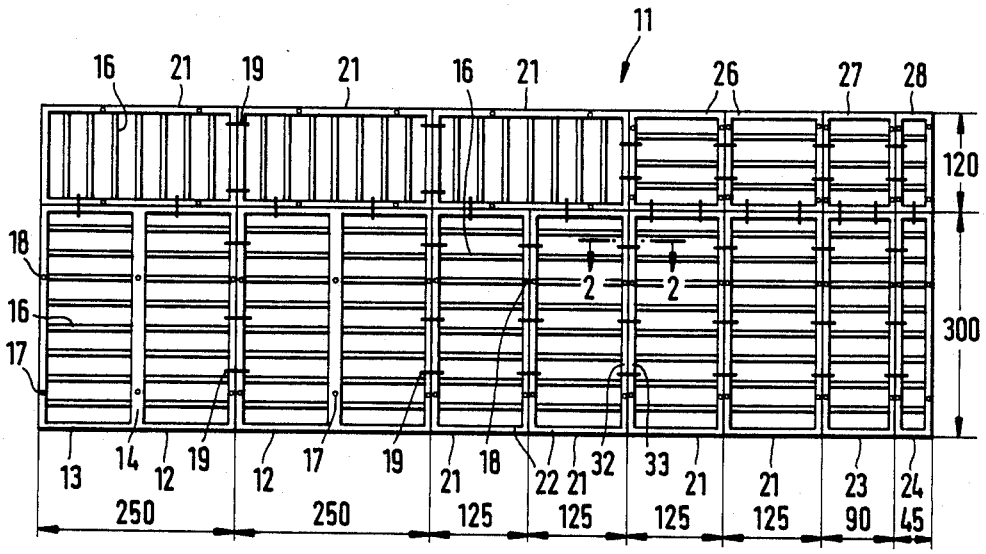
FIG. 1 is a form consisting of the assembly of several formwork panels, seen from the outside.

According to FIG. 1, an assembly 11 is built up for a forming height of 300 cm + 120 cm = 420 cm. The maximum forming height is therefore 420 cm. In the lower region, formwork panels 12 which are 250 cm wide are provided at the left. They have a profile frame 13, which extends around the outside and possesses a vertical central rib 14. In the bays between the vertical frame arms of the profile frame 13 and the central rib 14, there extend horizontal transverse members 16 at uniform spacings. In the vertical frame arms of the profile frame 13 and in the central rib 14, openings 17 and 18 for the tensile bars of formwork anchors are provided. The mutually adjacent, vertical frame arms of the profile frames 13 are connected together by formwork locks 19, of which three are used here. To the right, the assembly 11 continues with formwork panels 21 which also comprise a profile frame 22. The profile frames 13 and 22 are made from the same material with the same cross-section. The profile frames 22 are connected to one another and to the adjacent profile frame 13 by formwork locks 19.

All the formwork locks 19 are in principle of the same form. In the bays of the formwork panels 21, three formwork locks are also fitted through the height. The formwork panels 21 also have openings 17 and 18 at the same height as the formwork panels 12 and for the same purposes. The formwork panels 21 are 125 cm wide. The formwork panels 12 are produced from the formwork panels 21 by connecting together two adjacent, vertical frame arms, but not by formwork locks. Instead, they have been welded together, in order to create an element twice as large in width and area. In the case of the formwork panels 21, the transverse members 16 also extend horizontally and in alignment with the transverse members 16 of the formwork panels 12. At the right, the assembly 11 continues with a formwork panel 23, which is only 90 cm wide, but also 300 cm high. Since it, apart from its width, is of the same construction as the formwork panels previously described, it is not further explained. To the extreme right, a formwork panel 24 of 45 cm width is situated, which also does not require any further explanation.

The height of 300 cm is raised by a row of formwork panels mounted above, panels 21 once again being recognizable, which are arranged horizontally and are the same as the previously described formwork panels 21. It can also be seen that they are clamped by formwork locks 19 to one another and to the part of the assembly situated below them. Because the upper formwork panels 21 lie horizontally, their transverse members 16 are vertical. Corresponding to the smaller height of 1.20 m, only two formwork locks 19 are now used along the height. To the right, there adjoin further formwork panels 26, 27 and 28, which correspond in their width to the panels 21, 23 and 24 situated below, but which are only 1.20 m high and have horizontal transverse member 16. The clamping and arrangement of the openings can be seen from the drawing.

It is clear that the concrete pressure on the assembly 11 will be highest right at the bottom. It is not allowed, however, to avoid the resultant bulging for instance by the profile frames 13 becoming more solid towards the bottom, or for example by providing more transverse members towards the bottom, because then the flexibility of such an assembly 11 would no longer exist, because there would then be a "bottom" and "top" in the formwork panels. The formwork panels must be so constructed that it shall not be necessary to take note of aspects of this type.

Figure 3:
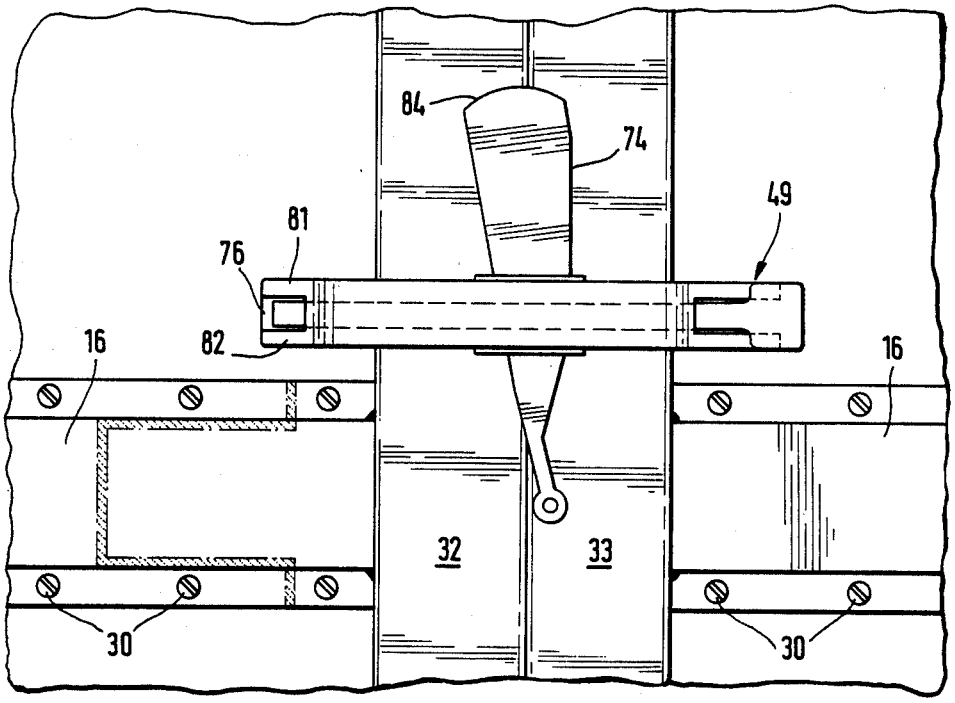
FIG. 3 is a view in the direction of arrow 3 in FIG. 2.
Figure 2:
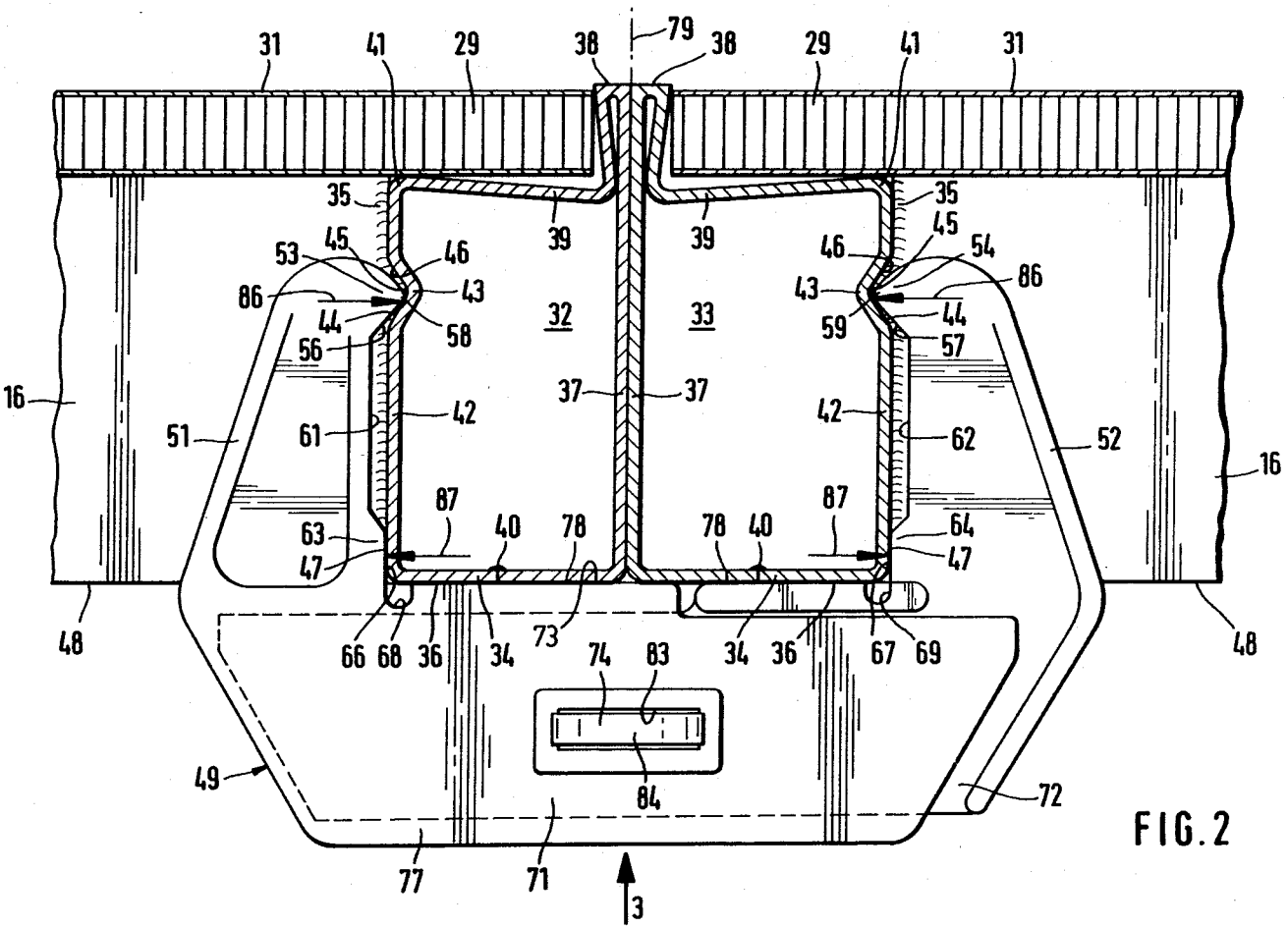
FIG. 2 is a horizontal section along the line 2—2 in FIG. 1.

FIGS. 2 and 3 each show a formwork panel plate 29, against the front face 31 of which concrete bears during concreting. The formwork panel plates 29 are supported from the rear by the transverse members 16. They are of steel and have a hat-shaped profile. They are screwed from the rear onto the formwork panel plates 29 by screws 30. Two frame arms 32, 33 have the same cross-section to opposite hand and are of steel.

FIG. 2 shows the cross-section. The frame arms 32, 33 are themselves known in their form and their properties as steel beams. In the case of the slender formwork panel 24, the transverse members 16 are scarcely loaded in bending, and here the frame arms 32, 33 carry a relatively larger proportion of the formwork pressure. In the case of the formwork panel 23, the transverse members 16 are already considerably more loaded in bending and in the formwork panels 21 the transverse members 16 are loaded to the maximum in bending and thus cause the frame arms 32, 33 to twist.

According to FIG. 2, the transverse members 16 are welded at their butt end by weld seams 35 to the frame arms 32, 33. The frame arms 32, 33 each have a first flange 34 with an external transverse surface 36. The first flanges 34 consist of two part flanges, which are butt-welded together by a weld seam 40. On the outer transverse face 36 the weld seam has been removed, so that the outer transverse faces 36 of both the frame arms 32, 33 can align exactly. Towards the center the first flanges continue at a 90 degree bend into second flanges 37, which bear against and are parallel to one another. These then continue into a known nose 38, which continues on the outer side of the formwork panel plate 29 as a third flange 39. The internal surface of the formwork panel plate 29 again bears against the knee 41. After the knee 41 there follows a fourth flange 42, which extends in a straight line, like the other flanges, with the exception of a corrugation 43. The corrugations 43 of both the frame arms 32, 33 lie exactly opposite each other, since the profiles are identical. Each corrugation 43 has a slope 44, which is inclined towards the formwork panel plate 29, and also a slope 46, which is inclined towards the first flange 34. At a bottom 45, the two slopes 44, 46 join each other. Every fourth flange 42 has, externally at the transition to the first flange 34, an external corner surface 47, which is none other than the external surface of the fourth flange 42. In the view of FIG. 2, the outer transverse surface 48 of the transverse members 16 runs above the outer transverse surfaces 36 of the first flanges 34 by the amount that is necessary for preventing the weld seam extending there from projecting downwards.

A formwork lock 49 is of malleable cast iron with an admissible sigma, that is sigma-tension and sigma-compression, of 800 kP (kilopond). At least 500 kP are necessary. The formwork lock has two claws 51, 52, which each have, at their upper, inner ends, a projection 53, 54 respectively facing towards each other, which projections each have an inwardly and downwardly oriented slope 56, 57 which is associated with the corresponding slope 44, 46, although it is not necessary, as indeed the drawing shows, for these slopes to have the same angle. If the angles differ, bearing takes place in the corner zone 58, 59 with a linear contact rather than an area contact. The corner region 50, 59 is situated outside the bottom 45. The projection 53, 54 is also at a distance from the slope 46 of both the corrugations 43.

The projections 53, 54 continue downwards into an internal surface 61, 62, which is at a clear distance from the fourth flange 42. In the region of the external corner surfaces 47, the claws 51, 52 each have, however, a projection 63, 64, the external surface 66, 67 of which bears with 30 kN against the associated external corner surface 47, 48. In order that the defined bearing conditions shall exist and that concrete dirt or the like shall not dictate the conditions, the external surfaces 66, 67 are each adjoined by a hollow throat 68, 69.

The corner regions 58, 49 are also subject to a force of 30 kN, if the external surfaces 66, 67 are subject to such forces.

The formwork lock 59 has a yoke 71, consisting of a web 72 which runs parallel to the first flange 34, extends to below the claw 51, has a bearing surface 73 for the external transverse surface 36 and has a rectangular hole, not illustrated, for a wedge 74. The web 72 is guided in a flat rectangular guide 76 of that web 77 which is integral with the claw 51. The web 77 has a bearing surface 78, facing upwards in FIG. 2, both for the external transverse surface 36 of the frame arm 32 and also for that of the frame arm 33, but in the latter case projecting only a short distance beyond the plane of symmetry 79. In the web 77, rectangular holes 83 for the wedge 74 are provided both in its upper wall 81 and also in its lower wall 82. For the tightening up, only a conventional formwork hammer is required, which usually has a weight of 1 kg or somewhat less. To tighten up, the head 84 is struck. In this way, the forces illustrated by the arrows 86, 87 are applied, the arrow 86 representing the force introduced at this point and the arrow 87 the reaction force at this point.

It will be seen that all that has been described in connection with FIGS. 2 and 3 is known, with the exception of the construction of the projections 63, 64, which have been thickened so far in the direction towards the plane of symmetry 79 that they bear there reliably and with the necessary force, while the corner region 58, 59 of the claws 51, 52 is no case meets the bottom 45.

If FIG. 3 is considered, it can immediately be seen that the projections 63, 64 are of use if, for example, with the right-hand formwork panel plate 29 held fixed, the left-hand formwork panel plate 29 is moved clockwise about a pivot axis which lies in the plane of symmetry 79 perpendicularly to the plane of the drawing of FIG. 2 and somewhere in the region of the noses 38. It can now be seen that the second flanges 37 cannot move apart from one another in such a manner as to allow a wedge-shaped, downwardly open gap to appear.

This type of loading occurs if an assembly, for instance, is suspended from a crane and swings.

If, however, concrete pressure is to be withstood, then the force upon the formwork panel plates 29 comes for the opposite side, namely in FIG. 2 from above, and because the transverse members 16 have a tendency to bulge downwards, the second flanges 37 try to move apart in such a manner that an upwardly open wedge-shaped gap would appear. It is just here that the invention provides a solution and we shall attempt by reference to FIG. 5 to explain the action.

The representation according to FIG. 5 is highly exaggerated. Also, the frame arms 32, 33 are illustrated only schematically, as also is the formwork lock 19. The position shown in full line corresponds to that of FIG. 2. If a loading from concrete now occurs, then the tendency to adopt the position shown in broken line now predominates. It can be seen that this position can only be adopted if the yoke 71 is above to become shorter, in other words the distance between the points 88 and 89 becomes shorter than the distance between the points 91 and 92. If, however, a hold is provided by the forces according to the arrows 87, then the position shown in broken line in FIG. 5 cannot be adopted and the frame arms 32, 33 remain in their position shown in full lines. The external surfaces 66, 67 of course bear, with friction and a force explained in greater detail above, against the external corner surfaces 47. So long as these conditions are fulfilled, the desired effect takes place. If the surfaces on both sides are of steel, then there is a coefficient of static friction, for example, which is approximately equal to the coefficient of sliding friction of 0.20. For aluminum/steel, the conditions can be understood at a glance.

FIG. 4 shows, for an extruded frame arm for the material Al Mg Si 0.5 F25, a profile that may be used for this invention. Here the first flange 34 is 4 mm thick corresponding to the force acting upon it. In the region of the first flange 34, the profile must be quasi-stiff in the transverse direction. In the region of slope 44, however, the fourth flange 42 must be able to deflect inwards to some extent. On account of the modulus of elasticity, which is somewhat less than that of steel, a transverse wall 93 is therefore provided here, which bears at the opposite side against the second flange 37 and can deflect like a leaf spring, without being permanently deformed.

The invention can also be used if the profile frames 13 are, for example, of glassfiber-reinforced plastic. The profile frames 13 may also be of foam plastic or foam material, regions then appearing instead of the separate flanges 34, 37, 39, 42, the outline of which cannot be so accurately defined as in the described embodiment, but which nevertheless have the same effect.

I claim:

1. Assembly of two formwork panels and a plurality of locks for clamping the panels together which assembly has a plurality of clamping positions corresponding to the number of formwork locks, each of said formwork panels having one formwork panel profile frame comprising two mutually parallel longitudinal frame arms, a plurality of stiff transverse members that are parallel to one another, are spaced approximately at equal intervals apart and have ends that are rigidly connected with said two mutually parallel frame arms, and a formwork panel plate situated against and supported by front surfaces of said transverse members, each of said frame arms having an outer transverse surface, an internal peripheral surface, a first sloping surface extending outwardly along said internal peripheral surface and facing towards said formwork panel plate, which sloping surface lies nearer to said formwork panel plate than to said outer transverse surface and is at a constant distance from said outer transverse surface, a first region possessing said outer transverse surface, a second region possessing an external bearing surface which is at least partly perpendicular to said formwork panel plate and bears against an external bearing surface of an adjacent formwork panel, a third region extending behind said formwork panel plate, and a fourth region possessing said first sloping surface and being spaced at a distance from said second region, first regions on adjacent formwork panels being in alignment, said first and fourth regions each forming a corner having an external corner surface on said fourth region, and said frame arms being elastically compressible perpendicularly to said fourth region in a region of said first sloping surface, each of said formwork locks comprising two claws, a yoke carrying said claws with an inner surface, and a wedge drive for each formwork lock that urges said two claws towards each other, said two claws having mutually-facing regions with second sloping surfaces that cooperate with said first sloping surfaces and press adjacent frame arms towards each other and towards said yoke, a flat bearing surface on said inner surface of said yoke, against which said outer transverse surfaces of said frame arms bear in aligning manner at least partially, and the improvement wherein:

(a) projections are provided on said mutually-facing regions adjacent to and contacting said corner surfaces, a free space being present between said projections and both said first and second sloping surfaces, (b) said first sloping surfaces have positions thereon to which movement of said second sloping surfaces on said claws is limited, (c) said projections always bear against said corner surfaces with a bearing force that is greater than opening forces on said profile frames that occur in operation, and (d) with said projections bearing against said corner surfaces, said second sloping surfaces on said claws are still at a distance from said limiting positions on said first sloping surfaces on said fourth region, even after forces have been applied onto said wedge drive by hammer blows from building hammers and before permanent deformation of said first and fourth regions.

2. Assembly according to claim 1, wherein said first region are substantially incompressible.

3. Assembly according to claim 1, wherein said first and second sloping surfaces are at a distance from said first regions equal to more than one-half of the width of said fourth regions from the formwork panel plate to the outer transverse surface.

4. Assembly according to claim 3, wherein said distance is about $\frac{2}{3}$ to $\frac{3}{4}$ of the width of said fourth regions.

5. Assembly according to claim 1, wherein said arms are of cold-rolled steel and form a closed profile.

6. Assembly according to claim 1, wherein said first regions consist of two flanges butt-welded together.

7. Assembly according to claim 1, wherein each formwork panel has a height of at least 250 cm and a width of at least 75 cm, in which the bearing force on said corner surfaces is between 15 and 50 kN.

8. Assembly according to claim 7, wherein said bearing force is from about 22.5 kN to 37.5 kN.

9. Assembly according to claim 8, wherein said bearing force is from about 27 kN to 33 kN.

10. Assembly according to claim 7, wherein said frame arms are of aluminum and more than three formwork locks are provided.

11. Assembly according to claim 1, wherein two to three clamping positions are provided along adjacent pairs of said frame arms of adjacent panels.

12. Assembly according to claim 1, wherein each formwork panel has a height of at least 250 cm. and a width of at least 75 cm., in which the bearing force on said corner surfaces is between 7 and 25 kN.

13. Assembly according to claim 12, wherein said bearing force is from about 11.25 kN to 18.75 kN.

14. Assembly according to claim 13, wherein said bearing force is from about 13.5 kN to 16.5 kN.

15. Assembly according to claim 1, wherein said projections are provided at least at said corner surfaces.

16. Assembly according to claim 1, wherein in said two formwork panels, each of said frame arms has the same cross-section and are of the same material as each other.

17. Assembly according to claim 1, wherein said two formwork panels, each of said transverse members has the same cross-section and are of the same material as each other.

18. Assembly according to claim 1, wherein said transverse members are at least half as high as the height of said fourth region from the formwork panel plate to the outer transverse surface.

19. Assembly according to claim 18, wherein said transverse members are 90 to 100% of the height of said fourth region.

20. Assembly according to claim 1, wherein said transverse members are welded at said ends to said fourth region.

21. Assembly according to claim 1, wherein said fourth regions of adjacent frame arms have a clearance between them and said projections have a clearance between them that corresponds to said clearance between said fourth regions of said adjacent frame arms.

22. Assembly according to claim 1, comprising about as many formwork locks as the number of transverse members, the number of locks not being less than the number of transverse members by more than 15%.

* * * * *